United States Patent [19]

Martel et al.

[11] 4,283,727

[45] Aug. 11, 1981

[54] SEPARABLE MICROWAVE COUPLING AND ANTENNA USING SAME

[75] Inventors: Jacques Martel; Roger Famin, both of Paris, France

[73] Assignee: Thomson-CSF, Paris, France

[21] Appl. No.: 4,985

[22] Filed: Jan. 19, 1979

[30] Foreign Application Priority Data

Jan. 27, 1978 [FR] France ..... 78 02337

[51] Int. Cl.[3] ..... H01Q 1/34

[52] U.S. Cl. ..... 343/710; 333/257

[58] Field of Search ..... 333/257, 254–256, 333/33; 343/709, 710, 750

[56] References Cited

U.S. PATENT DOCUMENTS

| | | | |
|---|---|---|---|
| 2,451,876 | 10/1948 | Salisbury | 333/257 |
| 2,564,007 | 8/1951 | Hochgraf | 333/257 |
| 3,812,578 | 5/1974 | Prinzhorn | 333/254 |

OTHER PUBLICATIONS

Turner, Robert W., "Submarine Communication Antenna System", Proceedings of the IRE 1/59, pp. 735–739.

*Primary Examiner*—David K. Moore

*Attorney, Agent, or Firm*—Karl F. Ross

[57] ABSTRACT

A transmission path between a source of microwaves, such as a radar transceiver, and a load rectilinearly movable with reference thereto, such as an aerial mounted on a retractable mast of a submarine periscope, comprises two relatively movable parallel waveguides respectively connected to a pair of coaxial ancillary guide portions with mating extremities which are separated from each other in one relative position and are interfitted in another relative position of the source and the load. The male guide portion is externally grooved to form microwave chokes whose effect is enhanced by a peripheral layer of energy-absorbent coating disposed beyond these chokes as seen from the female guide portion. The main waveguides may be coaxial with the interfitting guide portions or may extend parallel thereto and be connected to them by respective elbows.

9 Claims, 6 Drawing Figures

SEPARABLE MICROWAVE COUPLING AND ANTENNA USING SAME

FIELD OF THE INVENTION

The present invention relates to a separable microwave coupling designed to form a temporary joint between two relatively movable waveguides. Our invention also relates to the utilization of such a coupling in a telescopic antenna.

BACKGROUND OF THE INVENTION

There are technical applications in the microwave field where the problem may arise of making a connection between two waveguides which are movable relative to one another. In particular this problem may arise in the case where a telescopic antenna is to be used for instance in a shelter or, in a submarine, where a radar antenna may be fixed to the top of the slidable part of its retractable periscope mast. When the craft is submerged, the mast of the periscope is retracted, whereas during navigation on the surface the mast is extended so that the antenna is situated above metallic masses such as the conning tower, which would form a mask. In such an application, the line supplying microwave power to the antenna cannot be permanently connected to the transmitter/receiver of the radar. In fact, in one prior-art construction where the transmitter/receiver of the radar is situated in the control room, when the antenna is in the raised position the transmitter/receiver is connected to the microwave line by a device known as a "duck-bill". The connection is broken when the antenna is in the lowered position. The actual connection is achieved by applying two choked flanges together under pressure, one flange being secured to the microwave line and the other flange being secured to the transmitter/receiver assembly of the radar.

The disadvantage of such an arrangement is fairly obvious. Care has to be taken that the connection is properly made when the antenna is raised and that the flanges are not offset from one another by even a small amount at the moment of contact. Another disadvantage inherent in this arrangement for the radar of a submarine becomes apparent when it is desired to rotate the antenna, which is situated at the top of the movable part of the periscope mast. It is the mast itself, which is of circular cross-section, which turns, taking the antenna with it during its rotation, thus making it necessary for a rotary joint to be fitted at the base of the mast. However, if the mast rotates at high speed this gives rise to a wake which can easily be detected. To alleviate this disadvantage it is necessary to modify the shape of the mast.

OBJECTS OF THE INVENTION

The general object of our present invention, therefore, is to provide a separable coupling in a transmission path between a source of microwaves and a load, which obviates the aforedescribed disadvantages.

A more particular object is to avoid the need for establishing a mechanical connection between a radar transceiver and an aerial mounted atop a periscope mast of a submarine and to eliminate the necessity of rotating the mast during a radar sweep.

SUMMARY OF THE INVENTION

In accordance with our present invention, a pair of relatively movable main waveguides are respectively connected to the microwave source and the load while a male and a female ancillary guide portion are each rigidly connected with a respective one of these main waveguides, the two guide portions being coaxially disposed and being interfitted in a first relative position of the main waveguides to establish a continuous transmission path for the microwaves but being axially separated in a second relative position whereby the transmission path is interrupted.

Advantageously, pursuant to another feature of our invention, one of the coaxial guide portions—specifically the male one in the embodiments described hereinafter—is provided with leakage-prevention means on a peripheral surface which closely confronts but need not touch the other guide portion in their position of interengagement.

According to a further feature of our invention, the main waveguides and their associated guide portions are respectively supported on two telescoping tubes surrounding these waveguides whereby the latter undergo a rectilinear relative displacement in the axial direction of the guide portions as the tubes move between an extended and a retracted position. Especially when these tubes are part of a periscope mast, the guide portions are interfitted in the extended position but lie near opposite ends of the nested tubes in the retracted position.

BRIEF DESCRIPTION OF THE DRAWING

The above and other features of our invention will now be described in detail with reference to the accompanying drawing wherein.

SPECIFIC DESCRIPTION

Figure 1:
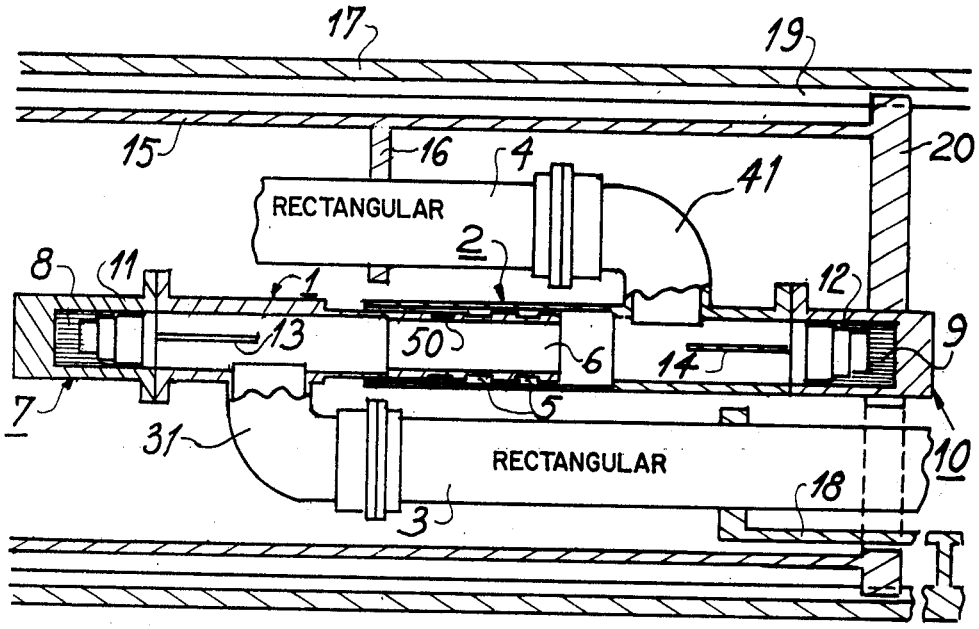
FIG. 1 is a part-sectional view of a separable coupling including two T-junctions between two circular and two rectangular guides.

FIG. 1 shows an embodiment of a separable coupling according to our invention which enables the establishment of a temporary connection between two relatively movable waveguides. This coupling comprises two circular ancillary waveguide portions 1 and 2, portion 1 being designed to fit slidably into the other portion 2. Guide portion 1 is connected to a waveguide 3 which, in the particular embodiment here described, is part of a microwave supply line. Guide portion 2 is connected by an elbow 41 to another waveguide 4 which forms an extension of the microwave supply line terminating at a load such as an aerial (see FIGS. 5 and 6). It will be noted that all four waveguides run parallel to the longitudinal axis of the coupling so that the whole assembly is rather compact, which is of great importance especially in the envisaged utilization of that assembly on a submarine. In order to connect circular-section guides such as the two aligned waveguide portions 1 and 2 to rectangular-section guides 3 and 4, T-junctions of the kind described for example in commonly owned U.S. Pat. No. 3,201,717. The insertion end 6 of the male guide portion 1 of the separable coupling is machined in such a way as to provide microwave chokes 5 in the form of circular grooves (cf. FIG. 4) which prevent leakage of energy to the exterior. The interfitting diameters of the guide portions 1 and 2 are likewise calculated to enable energy to be transmitted properly. The effect of the chokes is enhanced by the presence of an annular layer 50 of energy-absorbent material positioned between the chokes and the exterior. The closed opposite end 7 of the male guide portion 1 carries a dummy load 8 having a stepped internal configuration 11 which is designed to absorb energy propagated with an interfering polarization caused by whatever misalignment may exist between the two T-junctions. Also present are a similar dummy load 9 of stepped internal configuration 12 at the closed end 10 of the female guide portion 2, and longitudinally oriented short-circuiting plates 13, 14 which facilitate the transmission of microwave energy with the proper polarization from circular guides 1 and 2 to rectangular guides 3 and 4.

In its particular application to a submarine antenna, or any other antenna which has the length of its microwave supply line altered in the course of operation, a coupling as shown in FIG. 1 is inserted in an assembly of telescoped tubes as described hereinafter with reference to FIGS. 5 and 6.

Thus, guide 4 is shown secured to the inner tube 15 of a periscope mast by a support 16 whereas guide 3 is secured to the outer tube 17 thereof via a support 18. In general terms, the inner tube sliding in the outer tube entrains the mobile waveguide 4 which in turn carries along the associated guide portion 2 of the joint whose other portion 1 is connected to the stationary waveguide 3. When the antenna is operating, the sliding joint transmits microwave energy from one guide to the other.

It will be noted that the inside of the outer tube 17 is provided with a guide groove 19 which coacts with a support 20 secured to the inner tube 15, this combination preventing any rotary movement of the inner tube relative to the outer tube.

Figure 2:
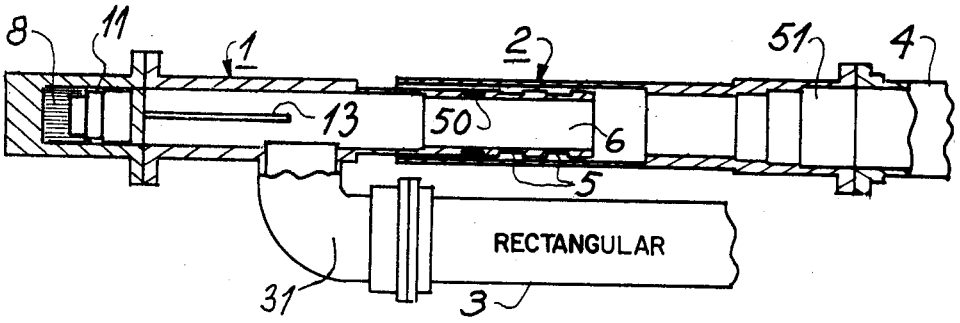
FIG. 2 is a part-sectional view of a coupling similar to that of FIG. 1 but with replacement of one T-junction by a straight connection.

FIG. 2 shows a telescopic coupling or sliding joint according to the invention in which there is only a single T-junction between a circular guide and a rectangular guide.

As in FIG. 1, there are two aligned guide portions 1 and 2 which constitute the joint proper. End 6 of guide portion 1 is again machined in such a way as to form chokes 5 which prevent energy from being lost to the exterior and whose effect is enhanced by a ring 50 of absorbent material attached to this guide portion. The other end 7 of guide portion 1 is again provided with a dummy load 8 of stepped internal configuration 11 and a short-circuiting plate 13 ahead of the junction between this circular guide and the stationary rectangular supply guide 3. The mobile rectangular extension guide 4 is situated in line with the sliding joint and is connected to guide portion 2 via a quarter-wave matching transformer of stepped internal configuration. The latter could be replaced by a tapered transition not shown in the drawing.

In FIG. 2, the periscope tubes surrounding the sliding joint are not shown but it is clear that they could be exactly like those of FIG. 1.

Figure 3:
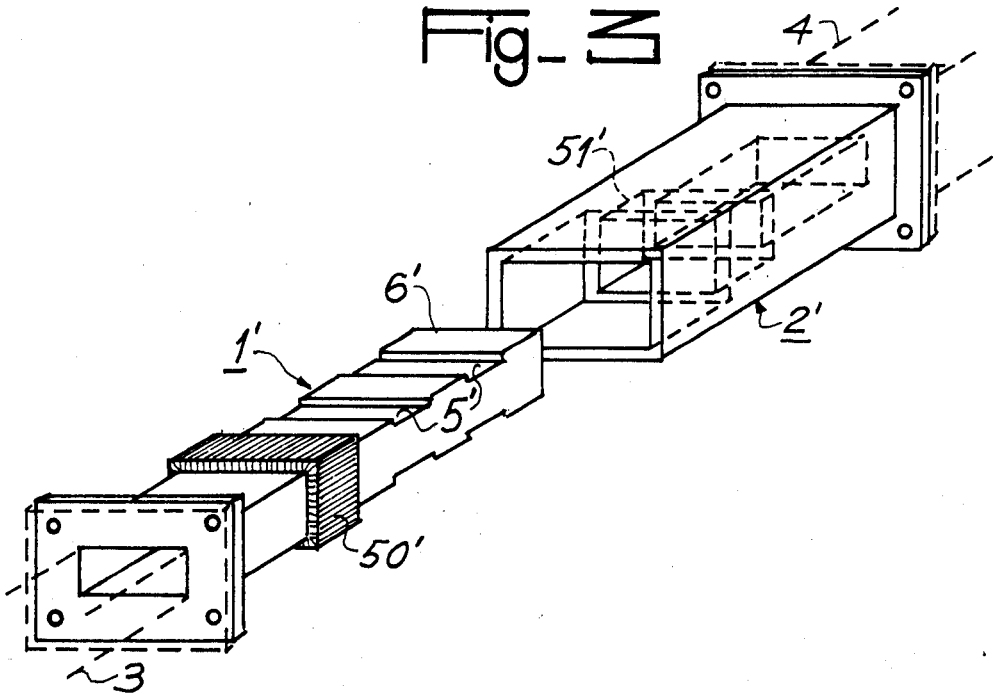
FIG. 3 is an exploded, axonometric view of a separable coupling formed entirely with rectangular guides.

FIG. 3 shows another embodiment of our invention which employs only rectangular-section waveguides. The coupling comprises a guide portion 1′ whose end 6′ is machined, to produce microwave chokes 5′ whose effect is enhanced by a peripheral layer 50′ of absorbent material embracing this portion. The male guide portion 1′ is able to slide in a female guide portion 2′ which is connected to supply guide 4 via a quarter-wave matching transformer 51′ again replaceable by a tapered transition. In this instance the main guides 3 and 4 are both in line with guide portions 1′ and 2′ to which they are respectively connected by flanges.

The manner of operation of the coupling of FIG. 3 is very similar to that of the couplings described with references to the previous Figures.

Figure 4:
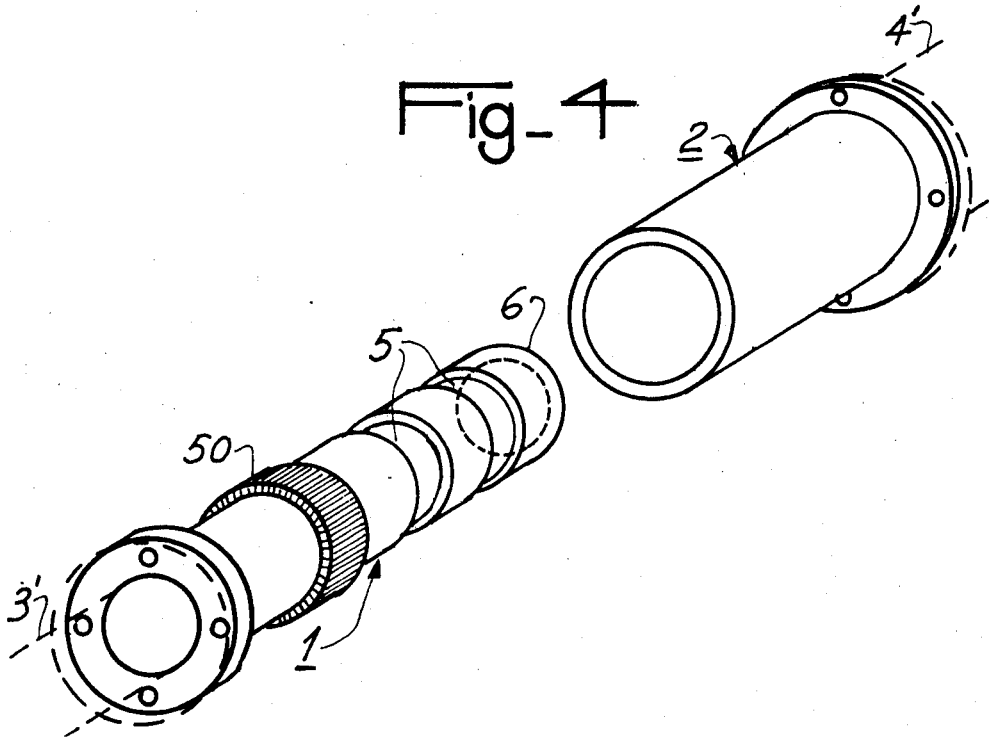
FIG. 4 is a similar view of a separable coupling formed entirely with circular guides.

In FIG. 4 we have shown the circular-section guide portions 1 and 2 of FIGS. 1 and 2 flanged to respective waveguides 3′ and 4′ of circular section coaxially aligned therewith.

Figure 5:
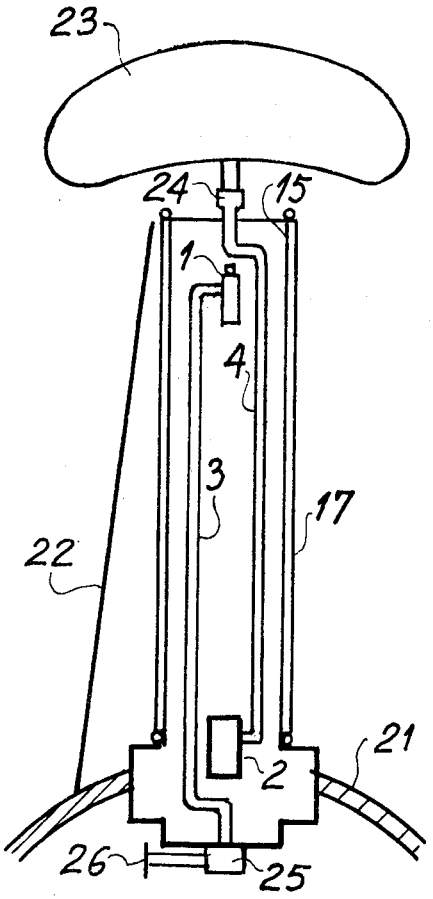
FIG. 5 is a schematic elevational view of a submarine antenna, in lowered position, which uses the separable coupling of FIG. 1.
Figure 6:
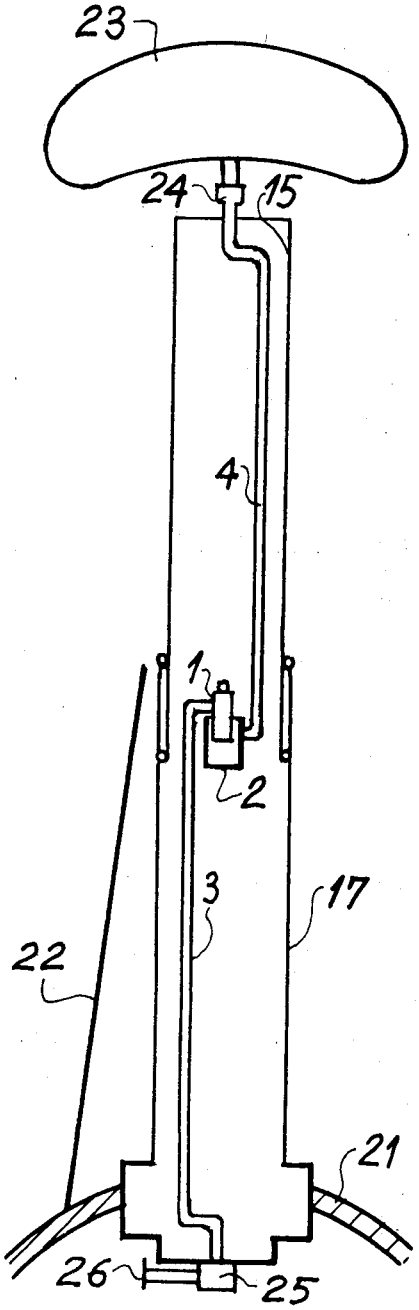
FIG. 6 is a similar view of the submarine antenna of FIG. 5 in raised position.

FIGS. 5 and 6 show a particular application of the separable joint according to the invention to a submarine antenna. FIG. 5 shows the antenna in its lowered position whereas FIG. 6 shows it in its raised position.

In FIGS. 5 and 6 we have diagrammatically illustrated at 21 the hull of the submarine, at 22 its conning tower and at 23 the antenna proper, which is rotatable about a vertical axis by being connected via a rotary joint 24 to the upper end of the mobile main waveguide 4. The guide portion 1 of the separable coupling, mounted on the stationary main waveguide 3, is secured to the outer tube 17 of the periscope in the manner shown in FIG. 1. The guide portion 2 of the coupling, together with the waveguide 4 to which it is connected, is similarly secured to the extendable inner tube 15 of the periscope. The lower end 25 of the fixed guide 3 is connected to a fixed transmitter/receiver 26 of a radar system. When the antenna has been raised into the elevated position of FIG. 6 the guide portion 2 surrounds the guide portion 1, thus forming the connection FIG. shown in FIG. 1. The assembly is now able to operate, energy being transmitted from guide 3 to guide 4 or vice-versa via the sliding joint.

We claimed:

1. In combination, relatively movable first and second main waveguides respectively connected to a source of microwaves and to a load, and a separable coupling between said main waveguides establishing a continuous transmission path for said microwaves in a first relative position thereof and interrupting said transmission path in a second relative position thereof, said coupling comprising a male and a female ancillary guide portion each rigidly connected with a respective main waveguide, at least the ancillary guide portion connected to said first main waveguide being provided with a dummy load, said guide portions being coaxially disposed and being interfitted in said first relative position but being axially separated in said second relative position.

2. The combination defined in claim 1 wherein one of said guide portions is provided with leakage-preventing means on a peripheral surface closely confronting the other of said guide portions in said first relative position.

3. The combination defined in claim 2 wherein said leakage-preventing means comprises a plurality of microwave chokes and a layer of energy-absorbing material disposed beyond said chokes as seen from said other of said guide portions.

4. The combination defined in claim 2 or 3 wherein said peripheral surface is an outer surface of said male guide portion.

5. The combination defined in claim 1 wherein at least one of said main waveguides extends parallel to said guide portions but offset from the axis thereof and is connected to the respective guide portion via an elbow junction.

6. The combination defined in claim 5 wherein said one of said main waveguides is of rectangular cross-section, said guide portions being of circular cross-section.

7. The combinatiom defined in claim 1, 2, 3, 5 or 6, further comprising a pair of telescoping inner and outer tubes surrounding said main waveguide portions, said main waveguides being respectively connected with said tubes for relative rectilinear displacement thereby in the axial direction of said guide portions.

8. The combination defined in claim 7 wherein said inner tube is extended from said outer tube in said first relative position and retracted into said outer tube in said second relative position, said guide portions being disposed near opposite ends of the telescoping tubes in said second relative position.

9. The combination defined in claim 8 wherein said tubes are part of a periscope mast of a submarine, said source comprising a radar transmitter aboard the submarine fixedly connected to one of said main waveguides, said load being an aerial above said mast coupled by a rotary joint to the other of said main waveguides.

* * * * *